US008246482B1

(12) United States Patent
Kim

(10) Patent No.: US 8,246,482 B1
(45) Date of Patent: Aug. 21, 2012

(54) GOLF STANCE TRAINER

(76) Inventor: Richard Kim, Lincoln, NE (US)

( * ) Notice: Subject to any disclaimer, the term of this patent is extended or adjusted under 35 U.S.C. 154(b) by 0 days.

(21) Appl. No.: 13/046,852

(22) Filed: Mar. 14, 2011

Related U.S. Application Data

(60) Provisional application No. 61/340,037, filed on Mar. 12, 2010.

(51) Int. Cl.
*A63B 69/36* (2006.01)

(52) U.S. Cl. ..... 473/272; 473/218; 473/273

(58) Field of Classification Search ..... 473/218, 473/219, 257, 266, 270, 272, 273
See application file for complete search history.

(56) References Cited

U.S. PATENT DOCUMENTS 2,180,170 A * 11/1939 Richards ..... 473/272
3,920,248 A * 11/1975 Medders ..... 473/218
4,647,048 A * 3/1987 Welch ..... 473/272
5,482,284 A * 1/1996 Vandever ..... 473/218
7,575,522 B1 * 8/2009 Affrunti ..... 473/273

* cited by examiner

*Primary Examiner* — Nini Legesse
(74) *Attorney, Agent, or Firm* — James Creighton Wray

(57) ABSTRACT

A golf swing stance trainer has a hub and a central telescoping arm connected to the hub. Side telescoping arms are connected to the hub for swinging outward to positions perpendicular to the central arm. The hub has ground-engaging cleats on a lower surface. The central arm is selectively extended outward for position with respect to a ball position. The side arms are selectively extended outward to indicate desired foot positions. Arm extensions are related to an individual user and club selection. The arms are telescoped inward and the side arms are swung inward for carrying. The hub includes a hinge rod with a central receive through which a connected on the central arm slides. The hinge rod has slots and holes through the slots at opposite ends. Side arm ends have complementary holes. Pins or screws extend through the holes, and washers allow turning the arms on the pins.

18 Claims, 6 Drawing Sheets

GOLF STANCE TRAINER

This application claims the benefit of U.S. Provisional Application No. 61/340,037, filed Mar. 12, 2010, which is hereby incorporated by reference in its entirety.

SUMMARY OF THE INVENTION

Briefly, the invention is a portable, retractable device that a golfer may use to insure that his stance is correct when addressing a golf ball. The training device consists of three telescoping legs extending from a central pivot. When unfolded and fully extended, two of the legs extend one hundred and eighty degrees apart from the central pivot and form a straight base line approximately thirty-six inches in length. A central leg extends from the central pivot point perpendicular to the base line. When fully extended, the central leg is thirty-six inches in length. When extended in this manner, the Swing Master forms a "T" with a thirty-six inch perpendicular bar and two eighteen inch base line bars. When fully folded, the device measures approximately 7"×2"×1".

The new extensible compact golf stance trainer shown in the drawings has a central locator cover connected to a threaded end of an extension of a central telescoping ball distance locator leg. A hinge rod has a central opening through which the central leg extension passes before the threaded end of the extension is connected to a threaded receiver in the cover. The hinge rod has opposite slotted ends and bases. Hinge pins extend through openings in opposite sides of end portions of the hinge rod. The hinge rod may be made cylindrical or square with parallel wall portions having opposite hinge pin receiving holes perpendicular to and spaced from the central opening through which the extension slides.

These and further and other objects and features of the invention are apparent in the disclosure, which includes the above and ongoing written specification, with the claims and the drawings.

DETAILED DESCRIPTION OF THE DRAWINGS

Figure 1:
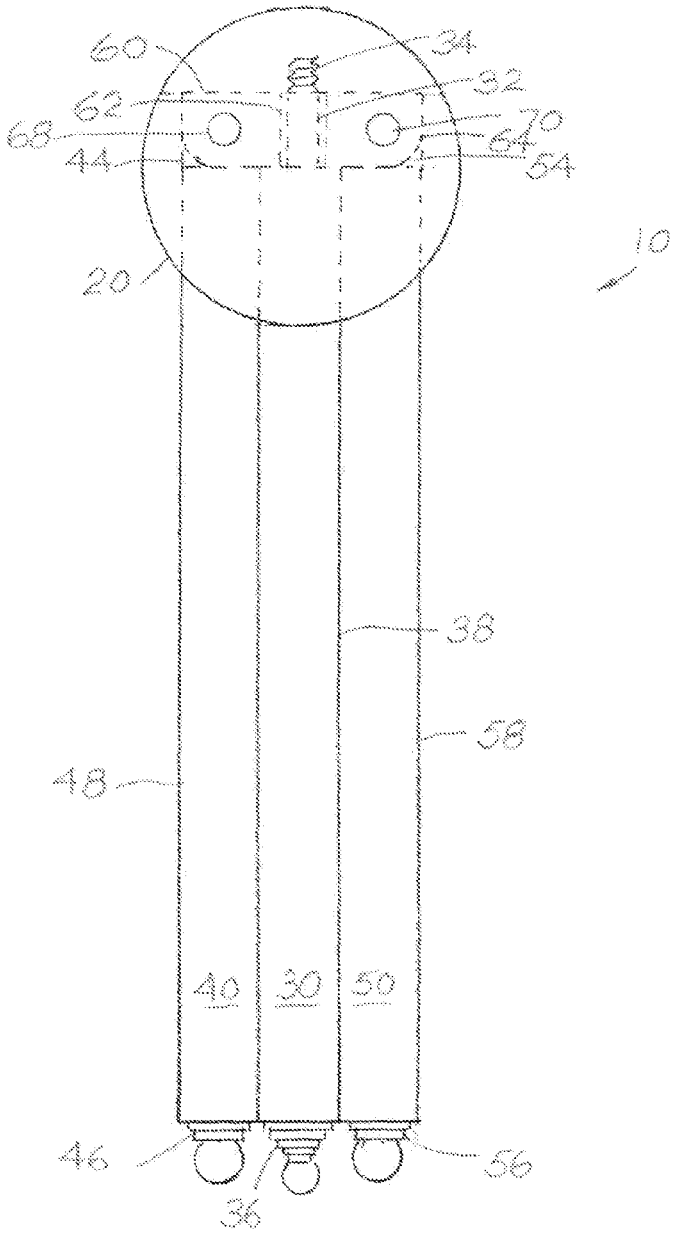
FIG. 1 is a top plan view of the golf stance trainer with arms telescoped and a hinge cover. The arms are folded for storing and carrying.
Figure 2:
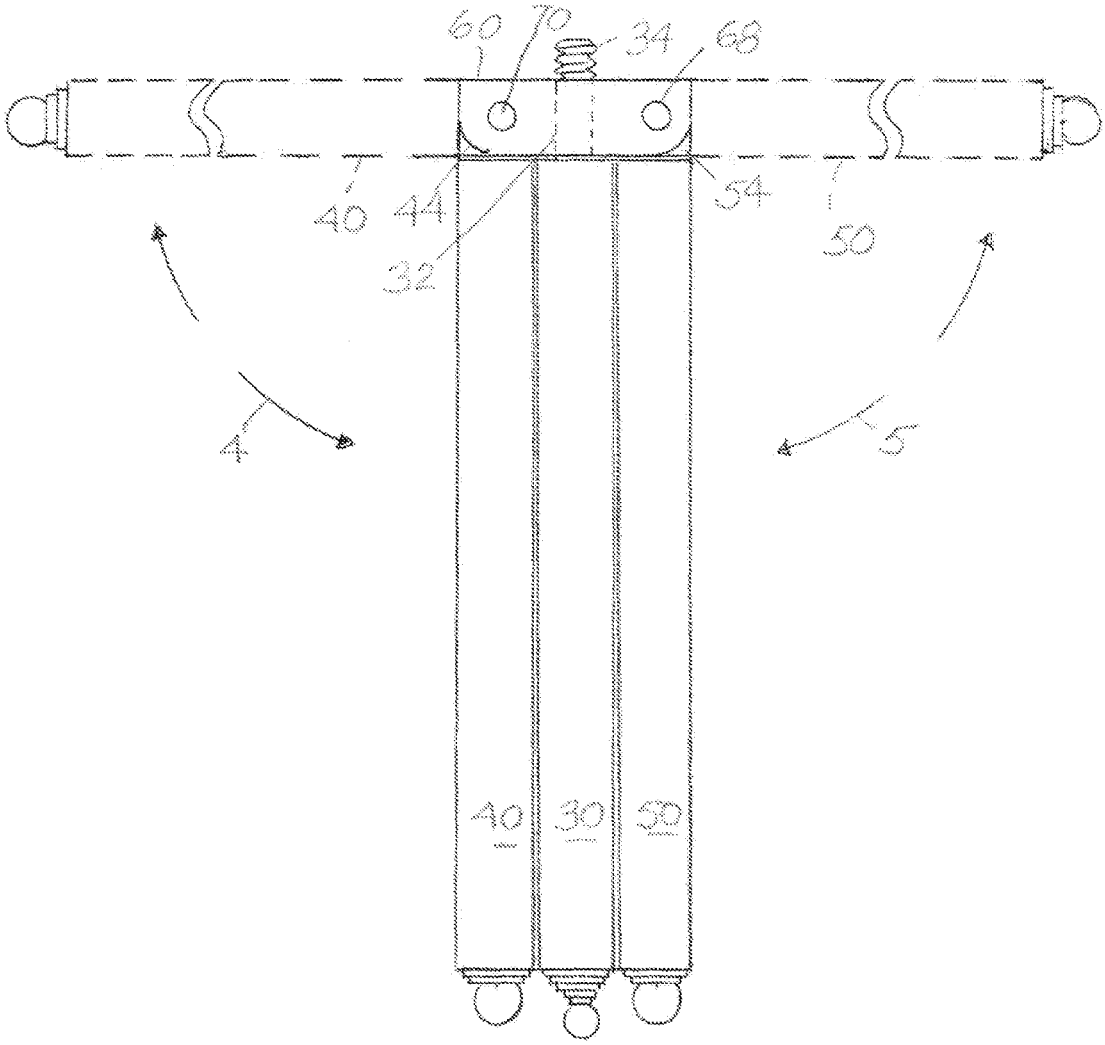
FIG. 2 is atop view of the trainer with the cover removed and with the hinged legs telescoped inward and folded for compact storing and carrying, showing how the side legs swing outward.

FIG. 1 is a top view of the golf stance 10 in storing and carrying condition with a cover 20 and telescoped legs 30, 40, 50. FIG. 2 is a top view of the trainer 10 with the cover 20 removed and with the hinged legs 40, 50 telescoped inward and folded for compact storing and carrying, showing by curved lines 4, 5 and dashed lines how the side legs 40, 50 swing out and in.

The new extensible compact golf stance trainer 10 shown in the drawings has a central locator cover 20 connected to a threaded end 34 of an extension 32 of a central telescoping ball distance locator leg 30. Foot position locator legs 40 and 50 have flattened inner ends 44, 54 which receive hinge pins 70 connected to hinge rod 60. A hinge rod 60 has a central opening 62 through which the extension 32 of arm 30 passes before the threaded end 34 is connected to a threaded receiver 24 in the cover 20. The hinge rod 60 has opposite ends 64 and bases 66 with recessed slots. Hinge pins 70 extend through openings 68 in opposite sides of end portions 64 of the hinge rod 60. The hinge rod may be, made of a cylindrical or square rod with openings 68 in wall portions spaced from and perpendicular to the central openings 62 through which the central leg extension 32 slides.

As shown in FIG. 1, the trainer 10 is folded. The cover 20 is connected to the threads 34 on extension 32 of central ball locating legs 30. Legs 40 and 50 are folded about pins 70 in hinge rod 60 and stored parallel with leg 30. The telescoping leg extensions 36, 46, 56 have been slid inward in the outer tubes 38, 48, 58.

The outer tubes 48 and 58 have pin receiving holes in flattened inner ends 44, 54. Ends 64 and bases 66 of hinge rod 60 are slotted 67 to receive the flattened ends in folded and extended positions of the legs. Holes in the flattened ends 44, 54 are aligned with paired holes 68 in hinge rod 60. Hinge pins 70 are inserted in the aligned holes. The hinge pins are set screws 70 with smooth shafts and threaded ends. Holes 68 in one side of the hinge rod are countersunk to receive the heads of set screws. Opposite holes in the hinge rod are tapped to receive threads of the set screws 70. When cover 20 is attached to threads 34 on the extension 32 of the fixed middle arm 30, the cover prevents unintentional backing out of the set screws 70.

In one embodiment, the flattened ends 44, 54 are provided on solid inserts which are crimped or welded in hinged inner ends of the legs 40 and 50. The ends of the tubes may have slots aligned with slots in the solid inserts and washer clips inserted in the aligned slots to hold inserts in the tube ends. Alternatively, the flattened ends 44, 54 may be flattened from the tubes 40, 50, and then drilled.

Figure 3:
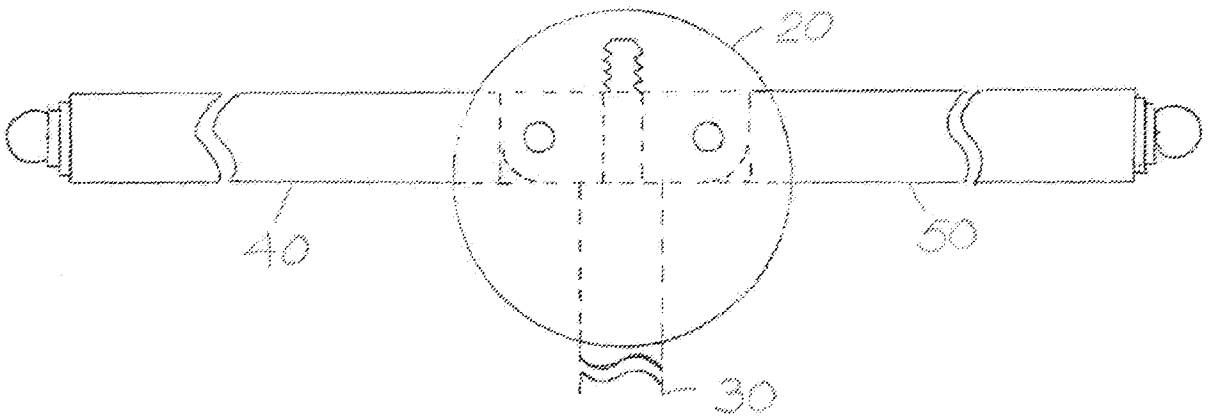
FIG. 3 is a top view detail showing the central locator cover connected to a threaded extension on the central ball distance locator leg and the side foot spacing legs rotated to their position of use before extending the foot spacing side legs.

FIG. 3 is a top view detail showing the central trainer locator cover 20 connected to the threaded end 34 extension 32 on the central ball distance locator leg 30. The side foot spacing legs 40, 50 have been rotated around pins 70 to their operational position of use before extending the foot spacing extension 46, 56 inside legs 40, 50.

Figures 4, 5:
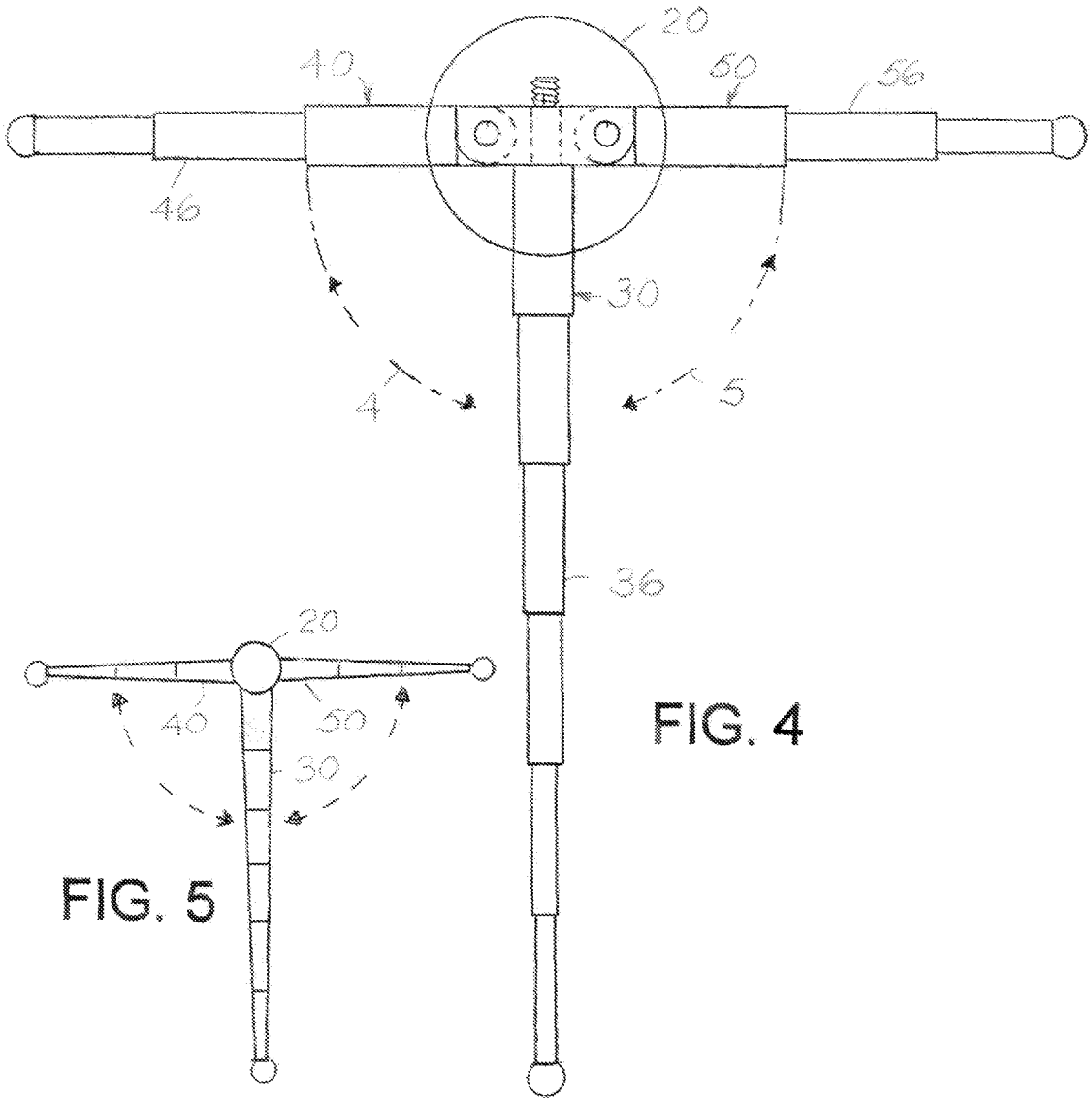
FIG. 4 is top view of the golf stance trainer with the legs extended and the cover in partially cut away view to show the relation and interconnection of the elements.
FIG. 5 is top schematic view of the golf stance trainer with the legs extended.

FIG. 4 is top view of the golf stance trainer 10 with the legs 40 and 50 rotated outward and telescoping tubes 36, 46, 56 extended. The cover 20 is partially cut away to show the relation and interconnection of the elements. The curved lines 4, 5 show rotations of the arms 40, 50 between the operational position as shown and the storage position.

FIG. 5 is top schematic view of the golf stance trainer 10 with the legs 30, 40, 50 extended.

Figure 6:
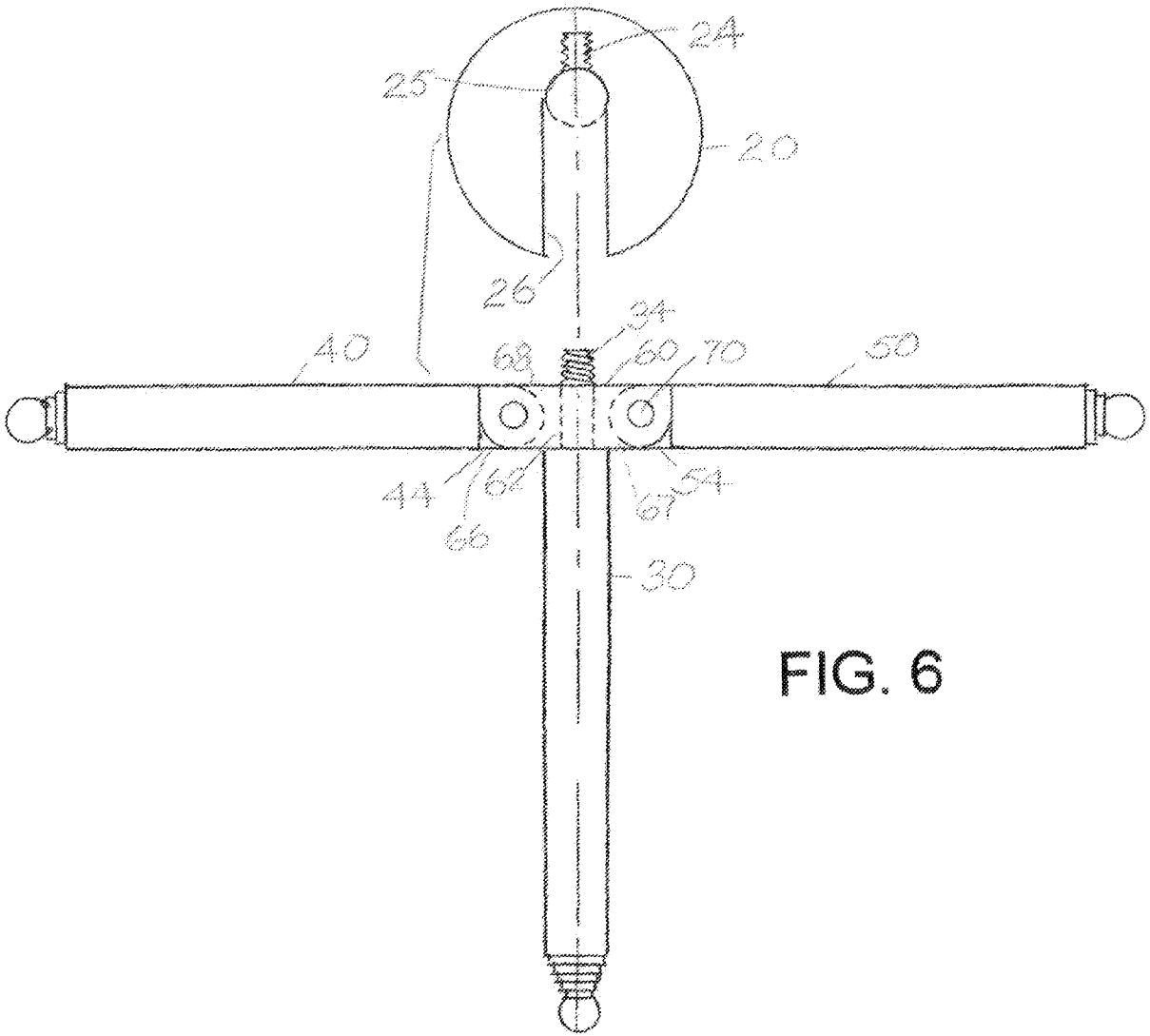
FIG. 6 is an exploded view showing the cover removed.

FIG. 6 is an exploded view of the trainer 10 showing the cover 20 removed. The inside of the cover 20 has been rotated 90° to show the leg-receiving slot 26 and the rounded inner top 25 of the slot to hold the hinge rod and legs.

Figure 7:
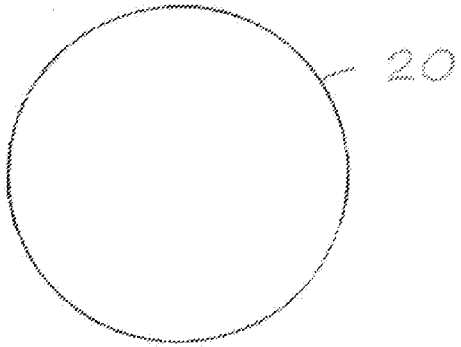
FIG. 7 is a top view of the central locator cover.

FIG. 7 is a top view of the central locator cover 20.

Figure 8:
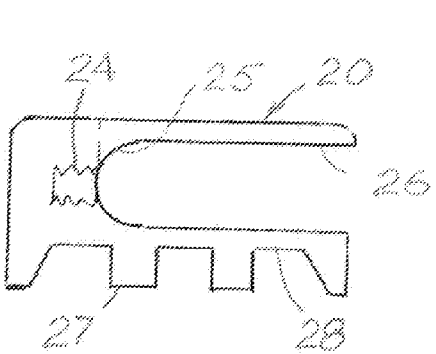
FIG. 8 is a side view of the central locator cover, showing the stabilizing ridges on the base.

FIG. 8 is a side view of the central locator cover 20, showing the slot 26 for swinging out the arms 40, 50. The hinge rod 60 is also shown and the extension 32 through the rod and threaded connection 34-24 to the cover 20. The stabilizing cleats 27 on the base 28 of the cover hold the central cover in position on the ground.

Figure 9:
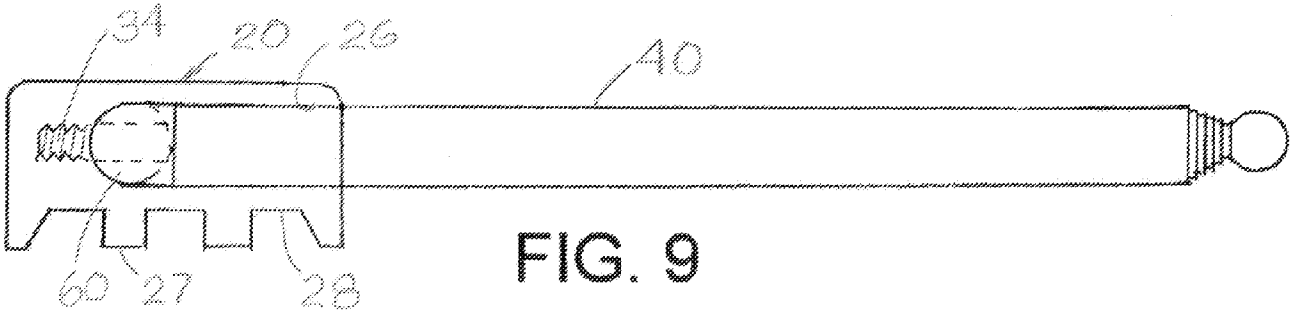
FIG. 9 is a side elevation of the central locator cover connected to the ball distance locator arm, which is shown telescoped prior to extending.

FIG. 9 is a side elevation of the central locator cover connected to the ball distance locator arm, which is shown telescoped, prior to extending.

While the invention has been described with reference to specific embodiments, modifications and variations of the invention may be constructed without departing from the scope of the invention, which is defined in the following claims.

I claim:

1. Apparatus comprising a golf stance trainer having three arms, a central arm and two side arms, each arm having first and second ends, one side arm being positioned on either side of the central arm, a hinge device connected to the arms, the hinge device has a central receiver for receiving a first end of the central leg, the hinge device having first and second ends, a first hinge connection at the first end and a second hinge connection at the second end of the hinge device, the side arms and the central arm being aligned for storing and carrying, and the first ends of the side arms being hinged to the hinge device for swinging out so that the second ends of the side legs are spaced from each other for use, wherein the hinge device comprises a hinge rod and wherein the hinge connections comprise slots in the first and second ends of the hinge rod.

2. The apparatus of claim 1, further comprising holes through the first and second slotted ends of the hinge rod perpendicular to the slots, complementary holes in the first ends of the side arms and first and second pins extending through the holes in the hinge rod and complementary holes in the first ends of the side arms.

3. The apparatus of claim 2, wherein the pins are screws.

4. The apparatus of claim 2, further comprising a cover having a cover slot and having a connector extending inward from a center of the cover slot for holding the first end of the central arm, the cover slot receiving the hinge rod with the first ends of the side arms connected to the hinge rod with the pins, the first end of the central leg having a complementary connector for extending through the receiver in the hinge rod and joining with the connector in the cover, holding the hinge rod and first ends of the side arms assembled in the cover.

5. The apparatus of claim 4, wherein the cover and cover slot extend outward beyond the ends of the hinge rod for limiting outward swinging travel of the side arms to positions in which the side arms are perpendicular to the central arm.

6. The apparatus of claim 5, wherein the cover has upper and lower surfaces parallel to sides of the cover slot, and wherein the lower surface has cleats for securing the cover against motion.

7. The apparatus of claim 1, wherein the arms are telescoping and extensible and are telescoped inward for carrying and storing and are extended outward for use.

8. Apparatus comprising a golf swing stance trainer for training user foot positions with respect to a golf ball position, the golf swing stance trainer further comprising a hub, a central arm having first and second ends, the first end of the central arm connected to the hub, and further comprising a hinge device connected to the hub, the stance trainer further comprising side arms having first and second ends, the first ends of the side arms connected to the hinge device, wherein the hinge device comprises a hinge rod and wherein the hinge connections comprise slots in the first and second ends of the hinge rod for enabling swinging of the side arms inward toward the central arm for storing and carrying with the arms parallel and for enabling swinging the side arms outward with the second ends of the side arms spaced from each other for positioning of user's feet with the side arms, and positioning of a golf ball with the central arm in preparation for swinging a golf club.

9. The apparatus of claim 8, wherein the arms are telescoping and extensible.

10. The apparatus of claim 8, further comprising holes through the first and second slotted ends of the hinge rod perpendicular to the slots, complementary holes in the first ends of the side arms and first and second pins extending through the holes in the hinge rod and complementary holes in the first ends of the side arms.

11. The apparatus of claim 8, wherein the pins are screws.

12. The apparatus of claim 8, further comprising a cover having a cover slot and having a connector extending inward from a center of the cover slot for holding the first end of the central arm, the cover slot receiving the hinge rod with the first ends of the side arms connected to the hinge rod with the pins, the first end of the central leg having a complementary connector for extending through the receiver in the hinge rod and joining with the connector in the cover, holding the hinge rod and first ends of the side arms assembled in the cover.

13. The apparatus of claim 8, wherein the cover and cover slot extend outward beyond the ends of the hinge rod for limiting outward swinging travel of the side arms to positions in which the side arms are perpendicular to the central arm.

14. The apparatus of claim 8, wherein the cover has upper and lower surfaces parallel to sides of the cover slot, and wherein the lower surface has cleats for securing the cover against motion.

15. The apparatus of claim 8, wherein the arms are telescoping and extensible and are telescoped inward for carrying and storing and are extended outward for use.

16. A method comprising using a golf stance trainer by extending a central arm from a hinge rod in a hub, positioning a golf ball, with respect to the central arm, swinging side arms outward on hinges wherein the hinges comprise slots in first and second ends of the hinge rod in a hub and extending the side arms, positioning a user's feet using the side arms as a guide, and positioning a golf ball using the central arm as a guide, further comprising stepping on the hub and pressing cleats extending from a bottom of the hub into the ground.

17. The method of claim 16, wherein the swinging of the side arms outward further comprises positioning the side arms perpendicular to the central arm.

18. The method of claim 16, further comprising telescoping the central arm inward, telescoping the side arms inward and swinging the side arms inward parallel to the central arm for carrying or storing the golf stance trainer.

* * * * *